United States Patent [19]

MacDonald et al.

[11] Patent Number: 4,483,109

[45] Date of Patent: Nov. 20, 1984

[54] BOOM LATCHING SYSTEM

[75] Inventors: Wayne P. MacDonald, McConnellsburg, Pa.; James L. Smith, East Calder, Scotland

[73] Assignee: JLG Industries, Inc., McConnellsburg, Pa.

[21] Appl. No.: 509,907

[22] Filed: Jul. 1, 1983

[51] Int. Cl.[3] ..... E04H 9/00

[52] U.S. Cl. ..... 52/1; 52/118; 212/267

[58] Field of Search ..... 52/1, 118; 212/149, 212/151, 152, 267; 182/19

[56] References Cited

U.S. PATENT DOCUMENTS

| | | | |
|---|---|---|---|
| 3,561,610 | 2/1971 | Buckert | 212/152 |
| 3,658,188 | 4/1972 | Lamer et al. | 212/149 |
| 3,940,110 | 2/1976 | Motoda | 212/149 X |
| 4,221,089 | 9/1980 | Spain | 212/267 |

FOREIGN PATENT DOCUMENTS

| | | | |
|---|---|---|---|
| 470488 | 8/1975 | U.S.S.R. | 212/196 |

*Primary Examiner*—Carl D. Friedman

[57] ABSTRACT

A latching system is disclosed for a telescopic boom, and comprises a ladder structure for positionment longitudinally along a side of a smaller boom section, and a latch plate assembly for a pivotal attachment to a large boom section. Bias means is further provided for applying a biasing force tending to move the latch plate into the ladder detent slot, and counter bias means for applying counter bias force to the latch plate. Linkages are adapted to extend between the latch plate and the tensioned chains which actuate the small boom section outward and inward relative to the large boom section, whereby the tension forces within the chains serve to provide counter biasing forces to the latch plate mechanism.

11 Claims, 5 Drawing Figures

BOOM LATCHING SYSTEM

BACKGROUND OF THE INVENTION

1. Field of the Invention

The present invention relates to latching systems for telescopic booms of the type comprising inward and outward telescopic boom sections. Specifically, the present invention relates to latching systems for telescopic booms of the type intended to provide an emergency stop in the event of actuator malfunction.

2. The Prior Art

Aerial work platforms of the general type to which the present invention is directed is disclosed in U.S. Pat. No. 3,776,367, and comprise a telescopic boom to the remote end of which a workmans platform is attached. The telescopic boom consists of progressively smaller dimensional boom sections receivable into each other, and the boom sections are hydraulically extended and retracted under the control of the operator. Specifically, as set forth in pending U.S. patent application Ser. No. 165,627, incorporated herein by reference, the telescopic boom sections are actuated by operation of parallel cables or chains, which are anchored at the base of the unit. These extension and retraction chains operate to extend and retract the boom.

An inherent danger with such a piece of equipment is the risk of the chains or cables becoming damaged and breaking. Such an event would cause the boom to retract in an uncontrolled fashion, creating the risk of harm to the operators positioned in the work basket. Further, the booms of such machines are designed to be capable of operation below the plane of the chassis wheels if necessary, that is, to be operated in such a manner so as to extend downward below ground level. There is therefore an additional danger in that a breakage of the chains or cables would under such use cause the boom to extend in an uncontrolled manner, thereby also risking injury to the operator.

Accordingly, manufacturers within the mobile aerial work platform industry have long been in need of a safety mechanism which in the event of cable or chain breakage, would safely and reliably inhibit retraction or extension of the boom. A common approach taken by those desiring to solve this problem has been to incorporate an electrical safety system into aerial work platforms. Typically, such systems use a latch which falls into boom notches continuously unless countered by a solenoid controlled force which is attended by the operators controls. Electrical actuation of the extension/retraction controls by the operator electrically actuates the solenoid and moves the latch away to permit boom movement. While these electrical systems have been effective to some extent, they are deficient in that they do not directly sense the status of the extension/retraction chain but rely upon the electrical integrity of the system. In the event that there is an electrical malfunction in the solenoid system or in the operators controls, the boom would be locked into an extended position, thereby stranding the operator and creating a potentially dangerous condition. Therefore, the electrical systems heretofore presented by the industry have failed to provide a dependable and effective means for sensing the condition of extension and retraction chains, and operating to disable further extension or retraction of the boom upon their breakage.

BRIEF SUMMARY OF THE PRESENT INVENTION

The present invention is directed towards a telescopic boom of a type above set forth. The boom latching system of the present invention comprises a ladder structure affixed to the one side of a smaller section boom segment, which ladder structure comprising at least one detent slot defined by side walls. A latch plate of specified construction is provided for pivotal attachment to the larger boom section, and has an end portion which is pivotal into the detent slot. A biasing means is described herein for applying a bias force to the latch plate, tending to rotate the latch plate into the detent slot. A counter bias means is further provided, and extends between the latch plate and the extension and retraction chains. The counter bias means in reaction to the tension in said chains, applies a counter bias force to the latch plate to keep the latch plate away from the locking detent slot when ever the chains are in their proper tensioned condition. Upon failure of the chains, the counter bias forces are removed from the latch plates, and the bias means operates to immediately rotate the latch plate into locking engagement within the detent slot.

According, it is an objective of the present invention to provide a latch system for a telescopic boom which is not dependent upon electrical continuity, and is immune from electrical failure of related systems.

A further objective of the present invention is to provide a latch system for a telescoping boom which directly couples to sense the tensile condition of extension or retraction cables of the boom.

Still a further objective of the present invention is to provide a latching system for telescopic boom having independent latching means for the extension and retraction chains, and independent means for detecting the condition of these chains or cables.

Yet a further objective of the present invention is to provide a latching system for telescopic boom which prevents sudden extension or retraction of boom sections in the event of chain failure.

Yet a further objective of the present invention is to provide a latch system for telescopic booms having an improved latching profile.

Yet a further objective of the present invention is to provide a latch system for telescopic booms having redundant mchanical latching systems.

Yet a further objective of the present invention is to provide a latch system for telescopic boom which is economically and readily produced.

These and other objectives, which will become apparent to one skilled in the art, are achieved by preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
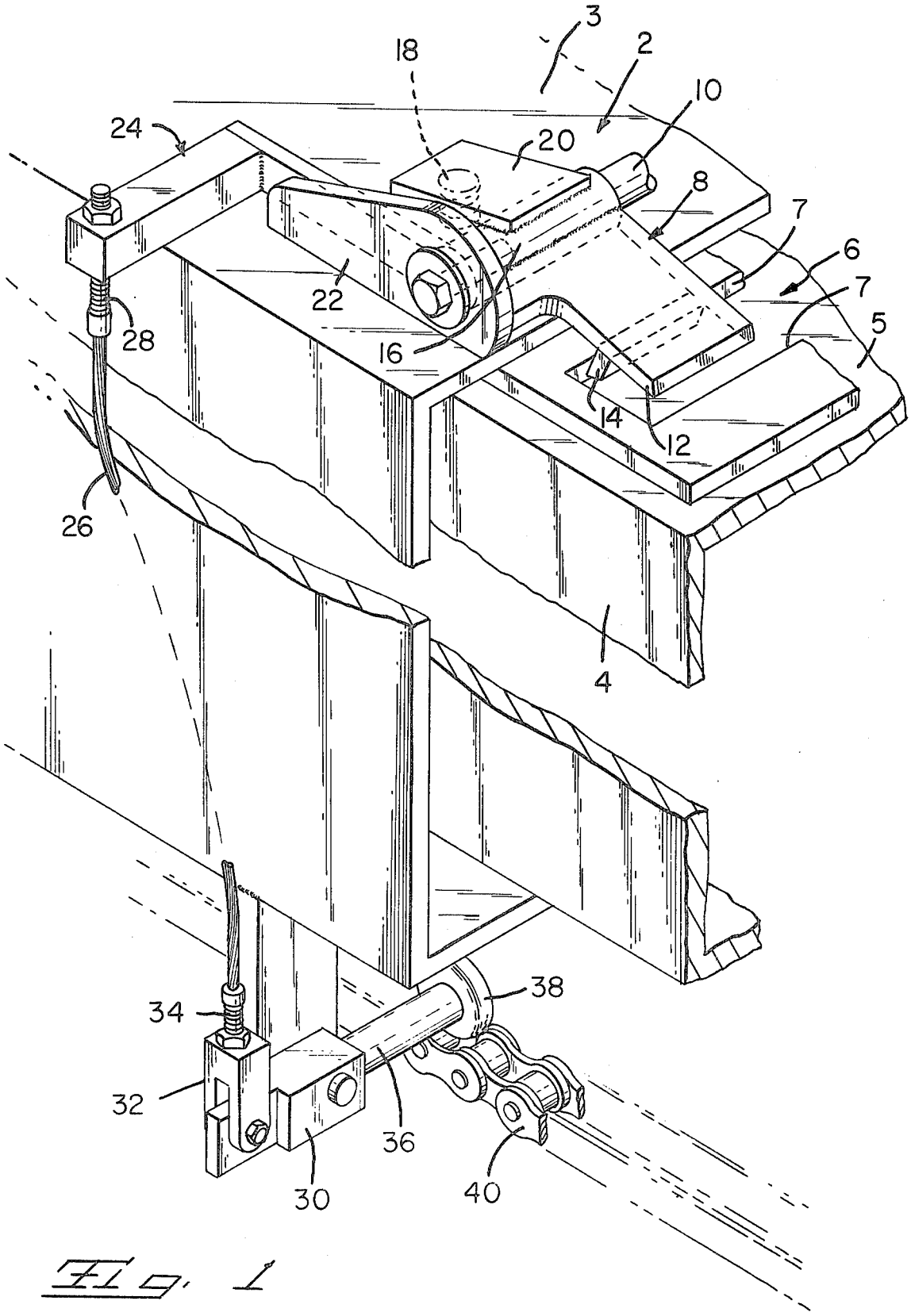
FIG. 1 is an assembled view of one-half of the double latching system comprising the preferred embodiment of the present invention.

Referring first to FIG. 1, the subject boom latch system 2 is intended for assembly to a telescopic boom, of the boom type comprising a relatively large rectangular cross section boom section 3, and a relatively small rectangular cross section boom section 4. The smaller boom section 4 is telescopically received within the larger boom section 3, and can be extended or retracted longitudinally relative thereto. Each of the boom sections is of a rectangular cross sectional configuration, and is fabricated by the weldment of steel plates. A boom of this general configuration is shown in U.S. Pat. No. 377,367, incorporated herein by reference.

The subject latch system 2 further comprises a plate 5 which is attached to an upper surface of boom section 4, and which has integrally formed cut outs or notches 6 longitudinally spaced there along (only one of which is shown). The notches 6 are defined by spaced apart parallel side walls 7 as shown in FIG. 1. The present invention further comprises a latch plate 8 of a generally rectangular configuration. One end of the latch plate 8 is pivotally secured to the larger dimensioned boom section 3 be means of a pivot pin 10. The opposite end of the latch plate 8, distal from the pivot pin 10, is constructed having a forked profile consisting of divergent flanges 12, 14. The lengthwise dimension of the latch plate is such that the divergent flanges 12, 14 are positioned generally above the upper surface of the samaller sectioned boom 4 to which the plate 5 is attached.

As shown, the latch plate 8 includes an integral tubular portion 16 which received the pivot pin 10 therethrough. Rearward of the latch plate 8, a compression spring 18 is positioned and affixed to the top surface of the boom section 3. Above the spring 18, an actuator plate 20 spans between the compression spring 18 and the tubular latch plate portion 16 in connection therewith. A pair of spaced apart mounting support plates 22 (only one of which is shown in FIG. 1) is provided to support the transversely extending pivot pin 10.

With further reference to FIG. 1, an "L-shaped" lever 24 is provided having a one end fixedly connected to the tubular mounting 16 of the latch plate 8, and having a second end projecting beyond a vertical side of the larger boom section 3. A rigid cable 26 is secured to the projecting end of the latch plate lever 24 by means of an adjustable screw fitting 28. The cable 26 extends generally downward the width of boom section 3. The opposite end of the cable 26 is connected at right angles to a pivot bar 30, by way of a clevis fitting 32 and an adjustable screw fitting 34. It should be noted that the cable 26 extends perpendicularly with respect to the latch plate lever 24 and the pivot bar 30. The pivot bar 30 is structured to provide a projecting neck portion 36, to the end of which a vertically oriented roller 38 is attached. Thus attached, the roller 38 rotates freely about a horizontal axis, and the pivot bar 30 is free to pivot vertically about the clevis fitting 32.

Telescopic booms of the type contemplated by the present invention are actuated by means of at least one longitudinally extending cable or chain. One of such chain linkages 40 is depicted in FIG. 1 as extending the length of the boom sections, intermediate of the sides. It will be noted that the roller 38 which is attached to the roller arm 36 is intended to be positioned in engagement with the tensioned chain linkage 40, such that the chain linkage tends to influence and pivot the pivot bar 30 upward.

Figure 2:
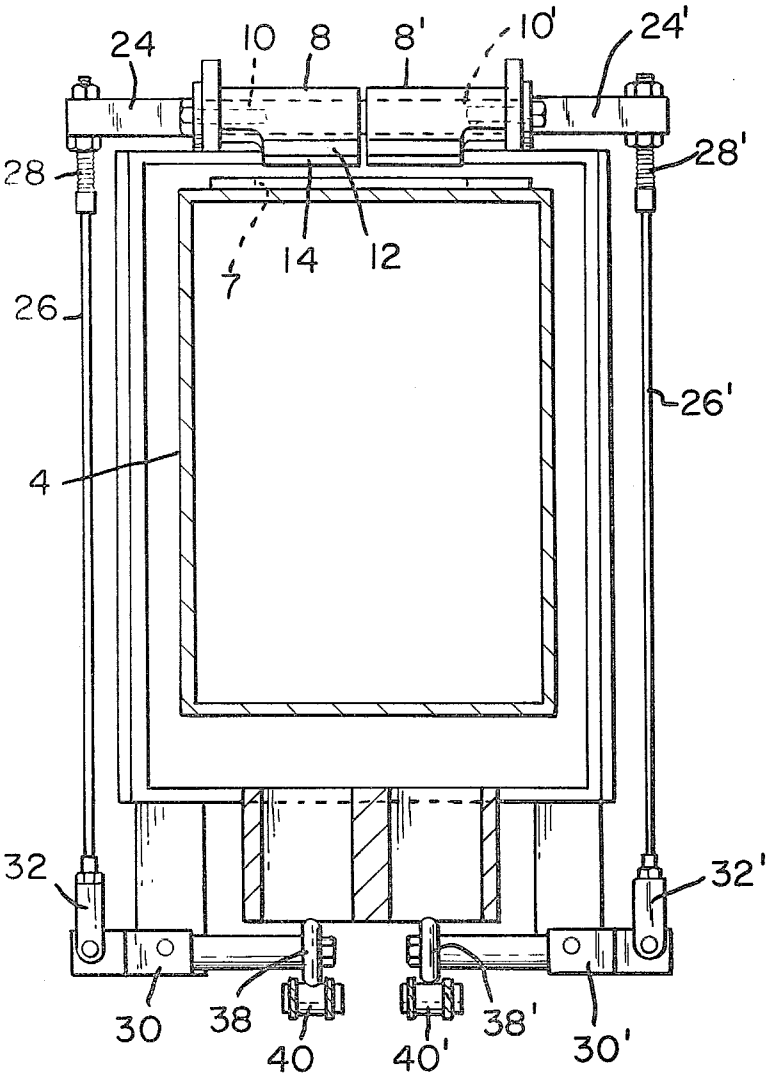
FIG. 2 is a frontal cross sectional view of the latching system comprising the present invention.

Proceeding to FIG. 2, a frontal section of the subject invention is shown in its assembled condition. As will be appreciated, the subject invention contemplates the use of a pair of identical latch plates 8, 8′ which are mounted to the larger boom section on a common axis of rotation about the pivot pin 10. The individual latch plates 8, 8′, and associated latch plate levers 24, 24′; cables 26, 26′; screw fittings 28, 28′; pivot bars 30, 30′; clevis 32, 32′, and rollers 38, 38′ and chains 40, 40′ are shown in FIG. 2. Chains 40, 40′ are parallel and extend the length of the boom. Rollers 38, 38′ engage respective chain lengths 40, 40′ and operate independent of each other. Cables 26, 26′ are parallel and spaced apart and receive the boom section 3 therebetween.

Figure 4:
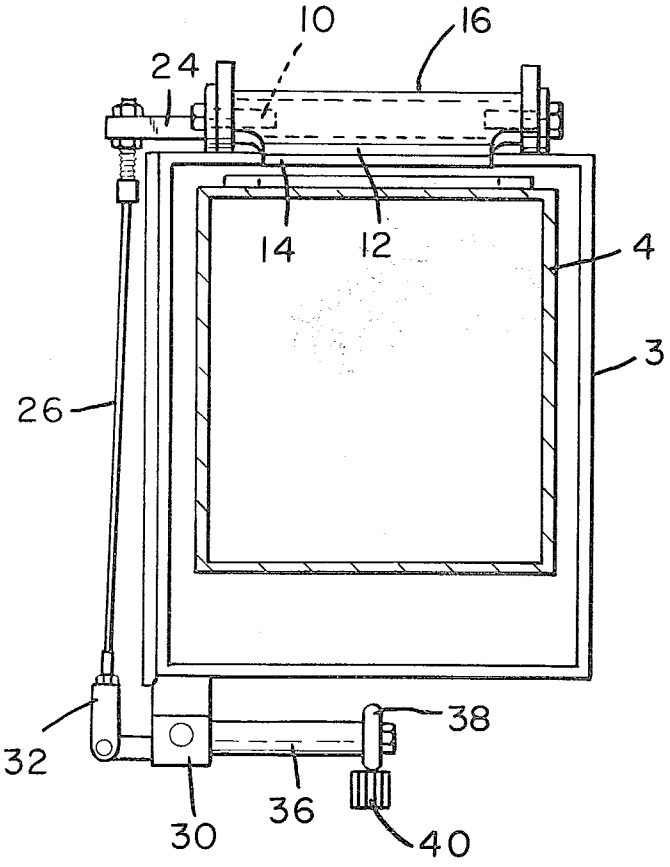
FIG. 4 is a frontal section view of a single latch system, comprising an alternative embodiment of the present invention.

FIG. 2 shows a dual latch embodiment of the present invention, while FIG. 4 illustrates the present invention in a single latch embodiment. A single latch may be utilized where a single chain or cable is to be monitored, and the double latch can be utilized when separate retraction and extension chains are present.

Figure 5:
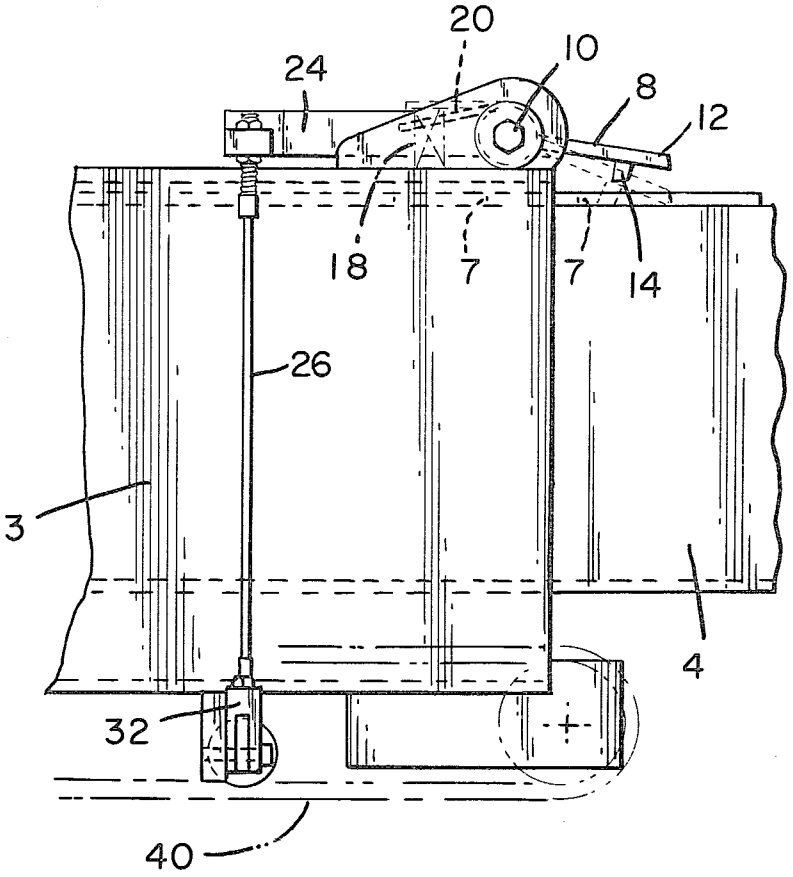
FIG. 5 is a side elevation view of the single latch embodiment of the present invention.

Referring now to FIGS. 1, 4, and 5, operation of the single latch embodiment of the present invention proceeds as follows. It will be noted that the roller arm 36 extends perpendicularly to the extension chain 40, and pivots unitarily with pivot bar 30 about the clevis connection 32. The roller 38, bearing against the tensioned chain 40 is thus influenced upward as viewed from FIG. 1. Upward pivoting motion of the pivot bar 30 causes a reactionary downward movement of the latch plate lever 24 via operation of the rigid cable 26. Corresponding downward motion of the latch plate lever 24 rotates the latch plate 8 in a counter clockwise direction, and moves the latch plate out of the slot 6. This counter clockwise rotation overcomes the bias of the compression spring 18, and restrains the latch plate away from latching engagement with the boom section 4.

In the event that the chain 40 should break, the restraining reaction provided by the roller 38 acting on the chain is removed, thus permitting release of the compression spring 18 to influence the latch plate 8, and cause a clockwise rotation thereof. Influence of the compression spring 18 is conducted by way of the actuator plate 20. The resultant clockwise rotation of the latch plate 8 causes the forward end of the latch plate to rotate into the ladder structure assembled to the boom section 4. The remote end flanges 12, 14 of the latch plate 8 thereby rotate into the ladder slot 6 as shown in FIG. 5. The above action will serve to limit any further movement of boom section 4 relative to boom section 3. The dual flanges 12, 14 serve to limit relative movement between the boom section 4, 5 in either direction, that is, boom section 4 can neither retract nor extend relative to boom section 3. Since booms of the subject type are intended to permit the boom to be extended downward if required, it is desirable to have a boom latch operate to prevent precipitous extension of the boom in the event of chain failure as well as uncontrolled retraction when the boom is elevated.

Figure 3:
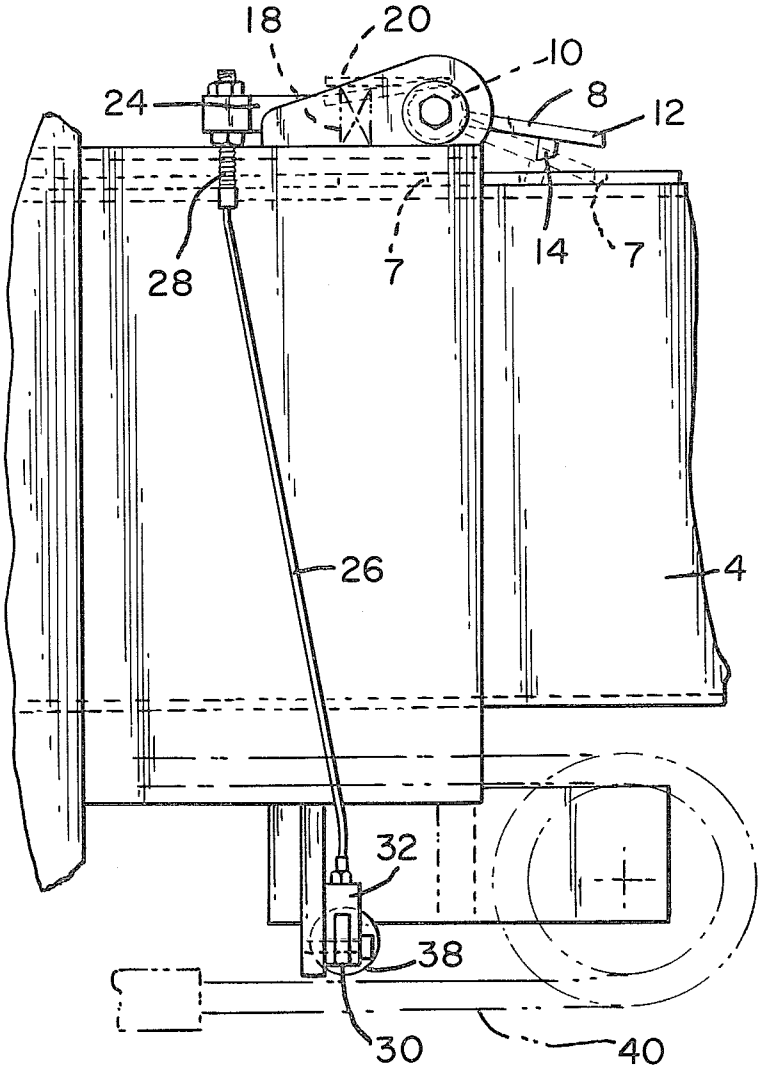
FIG. 3 is a side elevation view of the latching system comprising the present invention.

Operation of the dual latch embodiment of the present invention as shown in FIGS. 2, and 3, proceeds generally as described above for the single latch configuration. The dual chains 40, 40′ as shown in FIG. 2 are engaged by respective rollers 38, 38′, which act directly on the chains to provide a restraining reaction upon the latch plates 8, 8'. This restraining action is present so long as tension is maintained within the chains 40, 40'.

In the event that either chain breaks, the restraining action of the associate latch plate is removed, and the compression spring 20, 20' motivates that latch plate into rotational engagement with the ladder welded to the boom section 4. Thus, failure of either chain serves to limit relative movement between the telescopic boom sections.

From the foregoing it will be appreciated that the subject invention is not dependent upon electrical integrity, and is designed to mechanically sense the tensioning in boom chains, and react directly thereupon. This direct coupling to sense chain condition eliminates a failure mode which is unavoidable in electrically based sensing systems. Further, separate latch plates are provided for both the extension and retraction chains, and this duplicity causes immediate cessation of boom movement upon failure of either chain. The broad latitude of movement of such machines in telescoping the boom above and below horizontal is accomodated by the present invention in that both extension and retraction of the boom sections relative to one another is inhibited upon the breakage of either chain. Moreover, the latch plate configuration having dual divergent flanges at the remote end operates against the side walls defining the ladder slots to prevent movement bi-directionally.

While the above describes the preferred and an alternate embodiment of the present invention, other embodiments which utilize the teachings herein set forth are intended to be within the scope and spirit of the subject invention.

What is claimed is:

1. A boom latch system for a telescopic boom of the type comprising an outward relatively large boom section, and an inward relatively small boom section receivable into said large boom section, and longitudinally extending tensioned chain means for extending and retracting said small boom section relative to said large boom section, said latch system comprising:

ladder means for location longitudinally along a side of said small boom section and comprising at least one detent slot defined by side walls;

a latch plate for pivotal attachment to said large boom section and having a profiled remote end portion pivotal from a first position within said detent slot to a second position away from said slot;

bias means for applying a bias force to said latch plate tending to rotate said end portion into said detent slot;

counter bias means for extension between said latch plate and said chain means, said counter bias means applying a counter bias force to said latch plate in reaction to tension forces in said chains means, whereby said latch plate end portion is normally rotated away from said detent slot.

2. A boom latch system as set forth in claim 1, wherein said counter bias means comprising:

actuating lever means attached to said latch plate and rotational therewith;

rigid cable means having one end fixedly attached to said lever means and a second end positioned proximate to said chain means;

a bar member positioned perpendicular to said chain means, said bar member having one end pivotally attached to said second end of said cable means, and said bar member having a second end adapted to engage said chain means, whereby said tensioned chain means forcing said bar member into a pivotal reaction.

3. A boom latch system as set forth in claim 2, wherein said second end of said bar member comprising a roller.

4. A boom latch system as set forth in claim 1, wherein said remote end portion of said latch plate having a substantially inverted V-shaped profile comprising convergent flanges adapted to engage respective side walls defining said detent slot.

5. A boom latch system as set forth in claim 1, wherein said bias means comprising a compression spring for mounting to said outer boom section, and a plate having one end portion engaging against said compression spring and an opposite end attached to said latch plate.

6. A latching boom assembly comprising:

an outward relatively large boom section;

an inward relatively small boom section telescopically receivable into said large boom section;

longitudinally extending parallel first and second tensioned chain means for respectively extending and retracting said small boom section relative to said large boom section;

ladder means located longitudinally along a side of said small boom section and comprising at least one detent slot defined by side walls;

first and second latch plates for pivotal attachment to said large boom section and each having a profiled remote end portion pivotal from a first position within said detent slot to a second position away from said slot;

bias means for applying a bias force to each said latch plate tending to rotate said end portion into said detent slot;

counter bias means for extension between each said latch plate and said chain means, said counter bias means applying a counter bias force to each said latch plate in reaction to tension forces in said chain means, whereby each said latch plate end portion is normally rotated away from said detent slot.

7. A boom latch system as set forth in claim 6, wherein said counter bias 9 means comprising:

actuating lever means attached to each said latch plate and rotational therewith:

first and second rigid cable means having one end fixedly attached to a respective said lever means and a second end positioned proximate to a respective chain means:

first and second bar members positioned perpendicular to said chain means, said bar members having one end pivotally attached to said second end of a respective said cable means, and each said bar member having a second end adapted to engage a respective said chain means, whereby each said tensioned chain means forcing said bar member in engagement therewith pivotal reaction.

8. A boom latch system as set forth in claim 7, wherein said second end of each said bar member comprising a roller.

9. A boom latch system as set forth in claim 6, wherein said remote end portion of each said latch plate having a substantially inverted V-shaped profile comprising convergent flanges adapted to engage respective side walls defining said detent slot.

10. A boom latch system as set forth in claim 6, wherein said bias means comprising first and second compression springs for mounting to said outer boom section, and first and second linkage plates having one end portion engaging against a respective said compression spring and an opposite end attached to a respective said latch plate.

11. A boom latch system as set forth in claim 7, wherein said first and second cable means being parallel and spaced apart, and receiving said large boom section therebetween.

* * * * *